United States Patent [19]

Evans et al.

[11] Patent Number: 4,891,353

[45] Date of Patent: Jan. 2, 1990

[54] THIAZOLYLMETHYLENE-3,5-PYRAZOLIDINEDIONE DYE-DONOR ELEMENT FOR THERMAL DYE TRANSFER

[75] Inventors: Steven Evans, Rochester; Helmut Weber, Webster, both of N.Y.

[73] Assignee: Eastman Kodak Company, Rochester, N.Y.

[21] Appl. No.: 290,603

[22] Filed: Dec. 23, 1988

[51] Int. Cl.[4] ..... B41M 5/035; B41M 5/26

[52] U.S. Cl. ..... 503/227; 8/471; 428/195; 428/480; 428/913; 428/914

[58] Field of Search ..... 8/471; 428/913, 914, 428/195, 480; 503/227

[56] References Cited

U.S. PATENT DOCUMENTS

| | | | |
|---|---|---|---|
| 4,701,439 | 10/1987 | Weaver et al. | 503/227 |
| 4,743,582 | 5/1988 | Evans et al. | 503/227 |
| 4,760,049 | 7/1988 | Etzbach et al. | 503/227 |

FOREIGN PATENT DOCUMENTS

| | | | |
|---|---|---|---|
| 239290 | 11/1985 | Japan | 503/227 |

*Primary Examiner*—Bruce H. Hess

*Attorney, Agent, or Firm*—Harold E. Cole

[57] ABSTRACT

A dye-donor element for thermal dye transfer comprises a support having thereon a dye dispersed in a polymeric binder, the dye comprising a thiazolylmethylene-3,5-pyrazolidinedione. In a preferred embodiment, the dye has the formula:

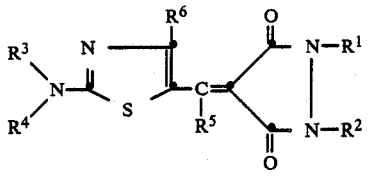

wherein $R^1$ and $R^2$ each independently represents hydrogen a substituted or unsubstituted alkyl group having from 1 to about 10 carbon atoms, a cycloalkyl group having from about 5 to about 7 carbon atoms, a substituted or unsubstituted aryl or hetaryl group having from about 2 to about 10 carbon atoms, or $R^1$ and $R^2$ can be joined together to form, along with the nitrogens to which they are attached, a 5- or 6-membered heterocyclic ring;

$R^3$ and $R^4$ each represents $R^1$ and $R^2$, respectively, with the proviso that only one of $R^3$ and $R^4$ may be hydrogen; and $R^5$ and $R^6$ each independently represents hydrogen; halogen; cyano; thiocyano; a substituted or unsubstituted alkyl, alkoxy, alkylthio or alkylsulfonyl group having from 1 to about 10 carbon atoms; a substituted or unsubstituted aryl or hetaryl, aryloxy or hetaryloxy, arylthio or hetarylthio, arylsulfonyl or hetarylsulfonyl group having from about 2 to about 10 carbon atoms; a cycloalkyl group having from about 5 to about 7 carbon atoms; alkoxycarbonyl; aryloxycarbonyl; acyl; carbamoyl; mono- or dialkylamino; mono- or diarylamino; acylamido; sulfonamido; or sulfamoyl.

20 Claims, No Drawings

THIAZOLYLMETHYLENE-3,5-PYRAZOLIDINEDIONE DYE-DONOR ELEMENT FOR THERMAL DYE TRANSFER

This invention relates to dye-donor elements used in thermal dye transfer which have good hue and dye stability.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of certain dyes in dye-donor elements for thermal dye transfer printing. Many of the dyes proposed for use do not have adequate stability to light. Others do not have good hue. It would be desirable to provide dyes which have good light stability and have improved hues.

JP 60/239,290 and U.S. Pat. No. 4,701,439 relate to arylidene dyes used in a thermal transfer sheet. All of these dyes, however, are benzylidenemalononitriles and do not contain thiazolylmethylene or pyrazolidinedione structural fragments. In addition, these dyes have poor light stability as will be shown hereinafter.

U.S. Pat. No. 4,760,049 relates to thiazolylmethylene-type arylidene dyes for use in a thermal transfer sheet. However, none of these dyes contains the pyrazolidinedione fragment. In addition, these dyes have poor light stability as will be shown hereinafter. It would be desirable to provide thiazolylmethylene-type arylidene dyes which have improved hues and stability to heat and light.

Application Ser. No. 168,837 entitled "Pyrazolidinedione Arylidene Dye-donor Element For Thermal Dye Transfer" by Evans et al. filed Mar. 16, 1988, relates to phenylmethylene-type dyes having a pyrazolidinedione fragment, but does not have the thiazolylmethylene fragment of the dyes described herein.

Substantial improvements in light stability and hues are achieved in accordance with this invention which comprises a dye-donor element for thermal dye transfer comprising a support having thereon a dye dispersed in a polymeric binder, the dye comprising a thiazolylmethylene-3,5-pyrazolidinedione. In a preferred embodiment, the dye has the formula:

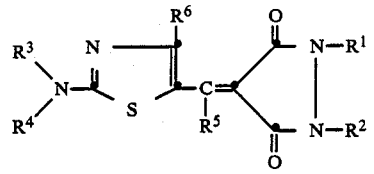

wherein $R^1$ and $R^2$ each independently represents hydrogen; a substituted or unsubstituted alkyl group having from 1 to about 10 carbon atoms, such as methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, etc.; a cycloalkyl group having from about 5 to about 7 carbon atoms, such as cyclohexyl, cyclopentyl, etc.; a substituted or unsubstituted aryl or hetaryl group having from about 2 to about 10 carbon atoms, such as phenyl, pyridyl, naphthyl, thienyl, pyrazolyl, p-tolyl, p-chlorophenyl, or m-(N-methyl sulfamoyl)phenyl; or $R^1$ and $R^2$ can be joined together to form, along with the nitrogens to which they are attached, a 5- or 6-membered fused heterocyclic ring such as pyrazolo [1,5-a]pyrazole or pyrazolo [1,5-a] pyridazine;

$R^3$ and $R^4$ each represents $R^1$ and $R^2$, respectively, with the proviso that only one of $R^3$ and $R^4$ may be hydrogen; and $R^5$ and $R^6$ each independently represents hydrogen; halogen, such as chlorine, bromine, or fluorine; cyano; thiocyano; a substituted or unsubstituted alkyl, alkoxy, alkylthio or alkylsulfonyl group having from 1 to about 10 carbon atoms such as methyl, ethyl, propyl, isopropyl, butyl, pentyl, hexyl, methoxyethyl, benzyl, methylthio, butylthio, benzylthio, methanesulfonyl, pentanesulfonyl, methoxy, ethoxy, 2-methanesulfonamidoethyl, 2-hydroxyethyl, 2-cyanoethyl, methoxycarbonylmethyl, etc.; a substituted or unsubstituted aryl or hetaryl, aryloxy or hetaryloxy, arylthio or hetarylthio, arylsulfonyl or hetarylsulfonyl group having from about 2 to about 10 carbon atoms, such as phenyl, thienyl, pyridyl, imidazolyl, naphthyloxy, furyl, p-tolylsulfonyl, p-chlorophenylthio, m-(N-methyl sulfamoyl)phenoxy, etc.; a cycloalkyl group having from about 5 to about 7 carbon atoms, such as cyclohexyl, cyclopentyl, etc.; alkoxycarbonyl, such as ethoxycarbonyl or methoxyethoxycarbonyl; aryloxycarbonyl; acyl, such as acetyl or benzoyl; carbamoyl, such as N,N-dimethylcarbamoyl; a mono- or dialkylamino group, such as dimethylamino; a mono- or diarylamino group, such as morpholino, anilino or pyrrolidino; acylamido; sulfonamido; or sulfamoyl.

In a preferred embodiment of the invention, both $R^1$ and $R^2$ are phenyl. In another preferred embodiment, $R^3$ is phenyl and $R^4$ is methyl. In yet another preferred embodiment, $R^6$ is phenyl. In yet still another preferred embodiment, $R^5$ is hydrogen.

Compounds included within the scope of the invention include the following:

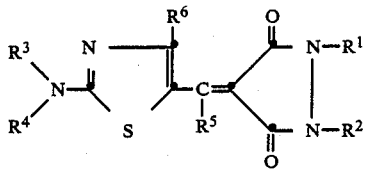

| Cmpd. | $R^6$ | $R^3$ | $R^4$ | $R^1$ | $R^2$ | $R^5$ |
|---|---|---|---|---|---|---|
| 1 | $C_6H_5$ | $C_6H_5$ | $CH_3$ | $C_6H_5$ | $C_6H_5$ | H |
| 2 | $C_6H_5$ | $C_6H_5$ | $C_2H_5$ | $C_6H_5$ | $C_2H_5$ | H |
| 3 | $C_6H_5$ | $C_6H_5$ | $C_2H_5$ | $[-(CH_2)_3-]$ | | H |
| 4 | $CH_3$ | n-$C_4H_9$ | H | $C_6H_5$ | $C_6H_5$ | H |
| 5 | 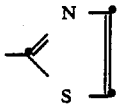 | $C_2H_5$ | $C_2H_5$ | $C_6H_5$ | $C_6H_5$ | H |
| 6 | H | $C_2H_5$ | $C_2H_5$ | $C_6H_5$ | $C_6H_5$ | H |
| 7 | $C_6H_5$ | $[-CH_2)_2O(CH_2)_2-]$ | | $CH_3$ | $CH_3$ | H |
| 8 | $-COCH_3$ | $C_6H_5CH_2-$ | $C_2H_5$ | $C_6H_5$ | $C_6H_5$ | H |
| 9 | $C_6H_5$ | $CH_3OC_2H_4-$ | $C_2H_5$ | $C_6H_5$ | $C_6H_5$ | $-CONHCH_3$ |
| 10 | H | $ClC_2H_4-$ | $C_2H_5$ | $C_6H_5$ | H | $-SC_3H_7$ |
| 11 | $-SC_6H_5$ | $C_2H_5$ | H | $C_6H_5$ | $C_6H_5$ | CN |
| 12 | $CH_3$ | n-$C_5H_{11}$ | n-$C_5H_{11}$ | $C_6H_5$ | $C_6H_5$ | Cl |
| 13 | $-SC_2H_5$ | $C_2H_5$ | $C_2H_5$ | $C_2H_5$ | $C_2H_5$ | $-CO_2C_2H_5$ |
| 14 | $-CO_2C_3H_7$ | $C_6H_5$ | H | n-$C_4H_9$ | n-$C_4H_9$ | H |
| 15 | H | i-$C_3H_7$ | H | p-Cl—$C_6H_4$ | p-Cl—$C_6H_4$ | $C_6H_5$ |
| 16 | 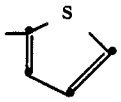 | $C_2H_5$ | $C_2H_5$ | $C_6H_5$ | $C_6H_5$ | $-SO_2C_2H_5$ |
| 17 | $-C_6H_5$ | $[-CH_2)_5-]$ | | $CH_3$ | $CH_3$ | H |
| 18 | $-SCN$ | $C_6H_5CH_2-$ | H | $C_6H_5$ | $C_6H_5$ | n-$C_4H_9$ |
| 19 | $-CN$ | $HOC_2H_4-$ | $C_2H_5$ | $C_6H_5$ | $C_2H_5$ | $-COCH_3$ |
| 20 | $-CON(CH_3)_2$ | $CH_3SO_2-NHC_2H_4-$ | $CH_3$ | $C_6H_5$ | $CH_3$ | $-SCN$ |

These dyes may be prepared analogous to the method described in Weaver et al. U.S. Pat. No. 3,247,211, and the synthesis of the requisite aminothiazole aldehydes is described in J. Chem. Soc., Perkins Trans I, 341–7 (1983), the disclosures of which are hereby incorporated by reference.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207 of Vanier and Lum; a polycarbonate; poly(styrene-co-acrylonitrile), a poly(sulfone) or a poly(phenylene oxide). The binder may be used at a coverage of from about 0.1 to about 5 $g/m^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 μm. It may also be coated with a subbing layer, if desired, such as those materials described in U.S. Pat. No. 4,695,288 of Ducharme or U.S. application Ser. No. 079,613 of Henzel, filed July 30, 1987.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. application Ser. Nos. 925,949 of Vanier, Harrison and Kan, filed Nov. 3, 1986; 925,948 of Harrison, Vanier and Kan, filed Nov. 3, 1986; 076,433 of Henzel, Lum and Vanier, filed July 21, 1987, and 062,796 of Vanier and Evans, filed June 16, 1987. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830; 4,698,651 of Moore, Weaver and Lum; 4,695,287 of Evans and Lum; and 4,701,439 of Weaver, Moore and Lum; and U.S. application Ser. Nos. 059,442 of Byers and Chapman, filed June 8, 1987; 059,443 of Evans and Weber, filed June 8, 1987; 095,796 of Evans and Weber, filed Sept. 14, 1987; and 123,441 of Byers, Chapman and McManus, filed Nov. 20, 1987, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of magenta, cyan and a dye as described above which is of yellow hue, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE

A yellow dye-donor element was prepared by coating the following layers in the order recited on a 6 μm poly(ethylene terephthalate) support:

(1) Subbing layer of duPont Tyzor TBT® titanium tetra-n-butoxide (0.16 g/m$^2$) coated from a n-butyl alcohol and n-propyl acetate solvent mixture, and (2) Dye layer containing dye 1 identified above of yellow hue (0.47 mmoles/m$^2$), FC-431® surfactant (3M Corp.) (0.002 g/m$^2$), in a cellulose acetate-propionate (2.5% acetyl, 48% propionyl) binder (weight equal to 2.0× that of the dye) coated from a cyclopentanone, toluene, and methanol solvent mixture.

A slipping layer was coated on the back side of the element similar to that disclosed in U.S. application Ser. No. 184,316 of Vanier et al., filed Apr. 21, 1988.

A dye-receiving element was prepared by coating a solution of Makrolon 5705® (Bayer AG Corporation) polycarbonate resin (2.9 g/m$^2$) and polycaprolactone (0.8 g/m$^2$) in methylene chloride on a pigmented polyethylene-overcoated paper stock.

The dye side of the dye-donor element strip approximately 10 cm × 13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C.) was pressed with a force of 8.0 pounds (3.6 kg) against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed at 29 μsec/pulse at 128 μsec intervals during the 33 msec/dot printing time. A stepped density image was generated by incrementally increasing the number of pulses/dot from 0 to 255. The voltage supplied to the print head was approximately 23.5 volts, resulting in an instantaneous peak power of 1.3 watts/dot and a maximum total energy of 9.6 mjoules/dot.

The dye-receiving element was separated from the dye-donor element. The status A blue reflection densities of each stepped image consisting of a series of 11 graduated density steps 1 cm×1 cm were read.

The images were then subjected to High-Intensity Daylight fading (HID-fading) for 7 days, 50 kLux, 5400° K., 32° C., approximately 25% RH and the densities were reread. The percent density loss was calculated from D-max (the highest density step). The λ-max of each dye in an acetone solution was also determined. The following results were obtained:

TABLE 3

| Dye-Donor Element w/ Compound | Fade Test (days) | $\lambda_{max}$ | Status A Blue Density $D_{max}$ | % Loss After Fade |
|---|---|---|---|---|
| 1 | 7 | 474 nm | 1.0 | 2 |
| Control 1 | 7 | 426 nm | 1.8 | 86 |
| Control 2 | 7 | 436 nm | 2.2 | 50 |
| Control 3 | 7 | 447 nm | 2.4 | 22 |
| Control 4 | 7 | 439 nm | 2.3 | 21 |

The above results indicate that the yellow dye according to the invention has improved light stability in comparison to several prior art control yellow dyes.

Control Compounds

Control Compound 1

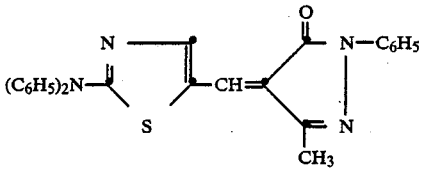

Control Compound 2

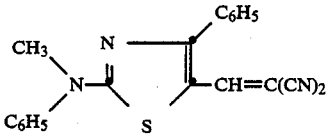

Disclosed in U.S. Pat. No. 4,760,049

Control Compound 3

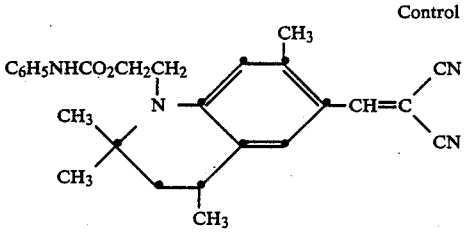

Disclosed in U.S. Pat. No. 4,701,439.

Control Compound 4

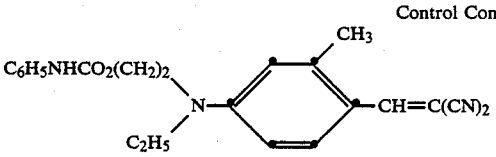

Disclosed in JP 60/239,290

The invention has been described in detail with particular reference to preferred embodiments thereof, but it will be understood that variations and modifications can be effected within the spirit and scope of the invention.

What is claimed is

1. A dye-donor element for thermal dye transfer comprising a support having thereon a dye dispersed in a polymeric binder, said dye comprising a 2-aminothiazol-5-ylmethylene-3,5-pyrazolidinedione.

2. The element of claim 1 wherein said dye has the formula:

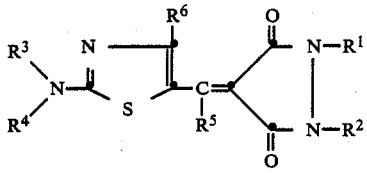

wherein $R^1$ and $R^2$ each independently represents hydrogen, a substituted or unsubstituted alkyl group having from 1 to about 10 carbon atoms, a cycloalkyl group having from about 5 to about 7 carbon atoms, a substituted or unsubstituted aryl or hetaryl group having from about 2 to about 10 carbon atoms, or $R^1$ and $R^2$ can be joined together to form, along with the nitrogens to which they are attached, a 5- or 6-membered heterocyclic ring;

$R^3$ and $R^4$ each represents $R^1$ and $R^2$, respectively, with the proviso that only one of $R^3$ and $R^4$ may be hydrogen; and $R^5$ and $R^6$ each independently represents hydrogen; halogen; cyano; thiocyano; a substituted or unsubstituted alkyl, alkoxy, alkylthio or alkylsulfonyl group having from 1 to about 10 carbon atoms; a substituted or unsubstituted aryl or hetaryl, aryloxy or hetaryloxy, arylthio or hetarylthio, arylsulfonyl or hetarylsulfonyl group having from about 2 to about 10 carbon atoms; a cycloalkyl group having from about 5 to about 7 carbon atoms; alkoxycarbonyl; aryloxycarbonyl; acyl; carbamoyl; mono- or dialkylamino; mono- or diarylamino; acylamido; sulfonamido; or sulfamoyl.

3. The element of claim 2 wherein both $R^1$ and $R^2$ are phenyl.

4. The element of claim 2 wherein $R^3$ is phenyl and $R^4$ is methyl.

5. The element of claim 2 wherein $R^6$ is phenyl.

6. The element of claim 2 wherein $R^5$ is hydrogen.

7. The element of claim 1 wherein said support comprises poly(ethylene terephthalate) and the side of the support opposite the side having thereon said dye layer is coated with a slipping layer comprising a lubricating material.

8. The element of claim 1 wherein said dye layer comprises sequential repeating areas of magenta, cyan and said dye which is of yellow hue.

9. In a process of forming a dye transfer image comprising imagewise-heating a dye-donor element comprising a support having thereon a dye layer comprising a dye dispersed in a polymeric binder and transferring a dye image to a dye-receiving element to form said dye transfer image, the improvement wherein said dye comprises a 2-amino-thiazol-5-ylmethylene-3,5-pyrazolidinedione.

10. The process of claim 9 wherein said dye has the formula:

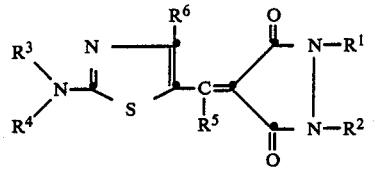

wherein $R^1$ and $R^2$ each independently represents hydrogen, a substituted or unsubstituted alkyl group having from 1 to about 10 carbon atoms, a cycloalkyl group having from about 5 to about 7 carbon atoms, a substituted or unsubstituted aryl or hetaryl group having from about 2 to about 10 carbon atoms, or $R^1$ and $R^2$ can be joined together to form, along with the nitrogens to which they are attached, a 5- or 6-membered heterocyclic ring;

$R^3$ and $R^4$ each represents $R^1$ and $R^2$, respectively, with the proviso that only one of $R^3$ and $R^4$ may be hydrogen; and $R^5$ and $R^6$ each independently represents hydrogen; halogen; cyano; thiocyano; a substituted or unsubstituted alkyl, alkoxy, alkylthio or alkylsulfonyl group having from 1 to about 10 carbon atoms; a substituted or unsubstituted aryl or hetaryl, aryloxy or hetaryloxy, arylthio or hetarylthio, arylsulfonyl or hetarylsulfonyl group having from about 2 to about 10 carbon atoms; a cycloalkyl group having from about 5 to about 7 carbon atoms; alkoxycarbonyl; aryloxycarbonyl; acyl; carbamoyl; mono- or dialkylamino; mono- or diarylamino; acylamido; sulfonamido; or sulfamoyl.

11. The process of claim 10 wherein both $R^1$ and $R^2$ are phenyl.

12. The process of claim 10 wherein $R^3$ is phenyl and $R^4$ is methyl.

13. The process of claim 10 wherein $R^6$ is phenyl.

14. The process of claim 10 wherein $R^5$ is hydrogen.

15. The process of claim 9 wherein said support is poly(ethylene terephthalate) which is coated with sequential repeating areas of magenta, cyan and said dye which is of yellow hue, and said process steps are sequentially performed for each color to obtain a three-color dye transfer image.

16. In a thermal dye transfer assemblage comprising:

(a) a dye-donor element comprising a support having thereon a dye layer comprising a dye dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said dye comprises a 2-amino-thiazol-5-ylmethylene-3,5-pyrazolidinedione.

17. The assemblage of claim 16 wherein said dye has the formula:

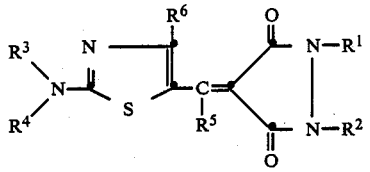

wherein $R^1$ and $R^2$ each independently represents hydrogen, a substituted or unsubstituted alkyl group having from 1 to about 10 carbon atoms, a cycloalkyl group having from about 5 to about 7 carbon atoms, a substituted or unsubstituted aryl or hetaryl group having from about 2 to about 10 carbon atoms, or $R^1$ and $R^2$ can be joined together to form, along with the nitrogens to which they are attached, a 5- or 6-membered heterocyclic ring;

$R^3$ and $R^4$ each represents $R^1$ and $R^2$, respectively, with the proviso that only one of $R^3$ and $R^4$ may be hydrogen; and $R^5$ and $R^6$ each independently represents hydrogen; halogen; cyano; thiocyano; a substituted or unsubstituted alkyl, alkoxy, alkylthio or alkylsulfonyl group having from 1 to about 10 carbon atoms; a substituted or unsubstituted aryl or hetaryl, aryloxy or hetaryloxy, arylthio or hetarylthio, arylsulfonyl or hetarylsulfonyl group having from about 2 to about 10 carbon atoms; a cycloalkyl group having from about 5 to about 7 carbon atoms; alkoxycarbonyl; aryloxycarbonyl; acyl; carbamoyl; mono- or dialkylamino; mono- or diarylamino; acylamido; sulfonamido; or sulfamoyl.

18. The assemblage of claim 17 wherein both $R^1$ and $R^2$ are phenyl, $R^3$ is phenyl and $R^4$ is methyl.

19. The assemblage of claim 17 wherein $R^6$ is phenyl.

20. The assemblage of claim 17 wherein $R^5$ is hydrogen.

* * * * *